US008777590B2

(12) United States Patent
Moy et al.

(10) Patent No.: US 8,777,590 B2
(45) Date of Patent: Jul. 15, 2014

(54) FLUID DELIVERY DEVICE IDENTIFICATION AND LOADING SYSTEM

(75) Inventors: Yei Feng Moy, Buffalo Grove, IL (US); John S. Ziegler, Arlington Heights, IL (US)

(73) Assignee: Hospira, Inc., Lake Forest, IL (US)

( * ) Notice: Subject to any disclaimer, the term of this patent is extended or adjusted under 35 U.S.C. 154(b) by 329 days.

(21) Appl. No.: 13/333,228

(22) Filed: Dec. 21, 2011

(65) Prior Publication Data

US 2012/0164006 A1 Jun. 28, 2012

Related U.S. Application Data

(60) Provisional application No. 61/426,348, filed on Dec. 22, 2010.

(51) Int. Cl.

| | |
|---|---|
| ***F04B 17/00*** | (2006.01) |
| ***F04B 35/00*** | (2006.01) |
| ***F04B 43/08*** | (2006.01) |
| ***F04B 43/12*** | (2006.01) |
| ***F04B 45/06*** | (2006.01) |

(52) U.S. Cl.

CPC ..... *F04B 43/08* (2013.01); *F04B 43/12* (2013.01)

USPC ..... 417/360; 417/474; 417/477.2

(58) Field of Classification Search

CPC ..... F04B 3/1253; F04B 43/12; F04B 43/082

USPC ..... 417/477.3, 474, 360, 477.2

See application file for complete search history.

(56) References Cited

U.S. PATENT DOCUMENTS

| | | | | | |
|---|---|---|---|---|---|
| 1,576,445 | A | * | 3/1926 | Mitchell | 417/211.5 |
| 2,903,165 | A | * | 9/1959 | Hanson et al. | 222/447 |
| 3,427,986 | A | * | 2/1969 | Corneil | 417/474 |
| 3,606,596 | A | * | 9/1971 | Edwards | 417/479 |
| 3,777,581 | A | * | 12/1973 | Sartori | 74/110 |
| 4,187,057 | A | | 2/1980 | Xanthopoulos | |
| 4,513,885 | A | | 4/1985 | Hogan | |
| 4,696,671 | A | | 9/1987 | Epstein et al. | |
| 4,842,584 | A | | 6/1989 | Pastrone | |
| 4,858,548 | A | * | 8/1989 | Echeverria | 112/443 |
| 5,098,262 | A | | 3/1992 | Wecker et al. | |
| 5,138,743 | A | | 8/1992 | Hoffman | |
| 5,282,787 | A | | 2/1994 | Wortich | |
| 5,462,256 | A | | 10/1995 | Minick et al. | |
| 5,586,868 | A | | 12/1996 | Lawless et al. | |
| 5,601,420 | A | * | 2/1997 | Warner et al. | 417/474 |
| 5,647,852 | A | | 7/1997 | Atkinson | |
| 5,673,588 | A | | 10/1997 | Raymond | |
| 5,816,779 | A | | 10/1998 | Lawless et al. | |
| 5,910,808 | A | * | 6/1999 | Fukasawa et al. | 347/30 |
| 6,231,320 | B1 | | 5/2001 | Lawless et al. | |

(Continued)

*Primary Examiner* — Devon Kramer
*Assistant Examiner* — Lilya Pekarskaya
(74) *Attorney, Agent, or Firm* — Michael R. Crabb

(57) ABSTRACT

A medical pump includes a chassis having a fixed seat and a carriage having a footing for receiving a fluid delivery device and restricting its movement. An actuator assembly is provided that allows for moving the carriage between an opened and closed position to engage the fluid delivery device to the seat. A rack and pinion system is utilized in combination with a cam element and spring element to provide a bi-stable actuator assembly that urges the carriage into a fully opened position or a fully closed position and will not allow the carriage to dwell in an intermediate position if external force is withdrawn.

12 Claims, 22 Drawing Sheets

(56) References Cited

U.S. PATENT DOCUMENTS

| | | | | |
|---|---|---|---|---|
| 6,325,264 | B1 * | 12/2001 | Omosako | 226/91 |
| 6,595,943 | B1 | 7/2003 | Burbank | |
| D504,507 | S | 4/2005 | Ziegler et al. | |
| 7,160,087 | B2 | 1/2007 | Fathallah et al. | |
| 7,258,534 | B2 * | 8/2007 | Fathallah et al. | 417/477.2 |
| 8,152,486 | B2 * | 4/2012 | Fathallah et al. | 417/360 |
| 2005/0095152 | A1 * | 5/2005 | Dale | 417/477.2 |
| 2005/0214129 | A1 | 9/2005 | Greene et al. | |
| 2005/0260090 | A1 * | 11/2005 | Stark et al. | 417/559 |
| 2007/0058412 | A1 | 3/2007 | Wang et al. | |
| 2008/0038130 | A1 * | 2/2008 | Fathallah et al. | 417/477.2 |
| 2008/0145249 | A1 * | 6/2008 | Smisson et al. | 417/474 |
| 2010/0094224 | A1 | 4/2010 | Fathallah et al. | |

* cited by examiner

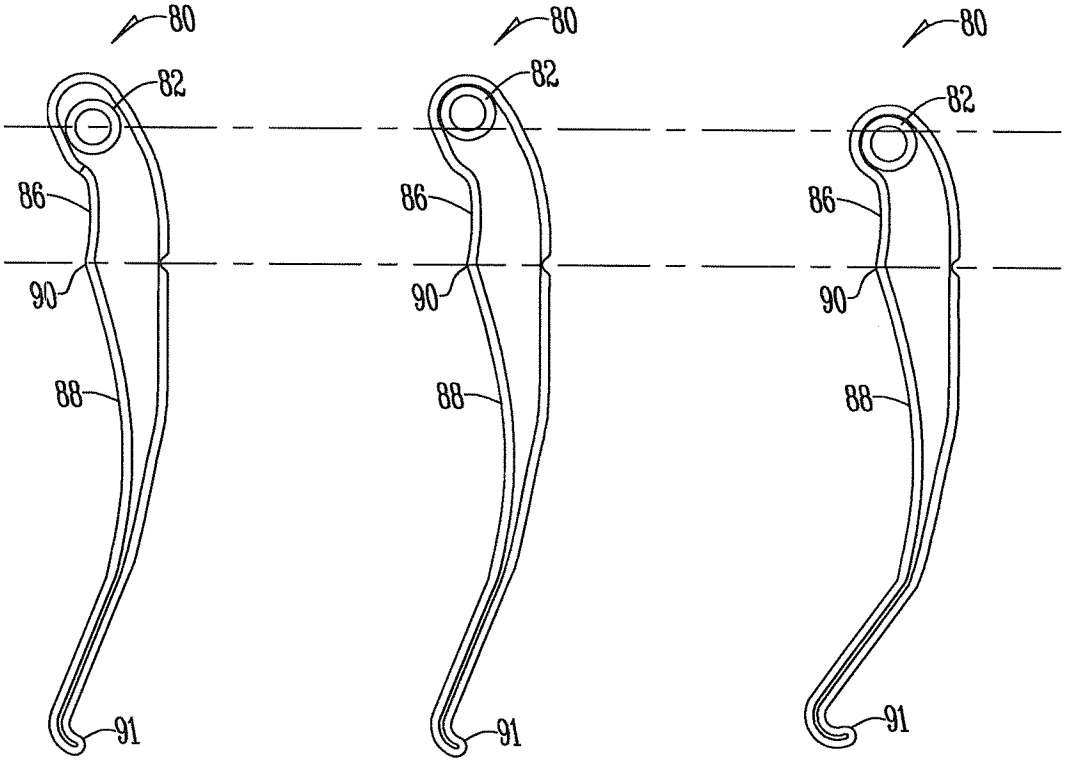
Fig. 7A
Fig. 7B
Fig. 7C
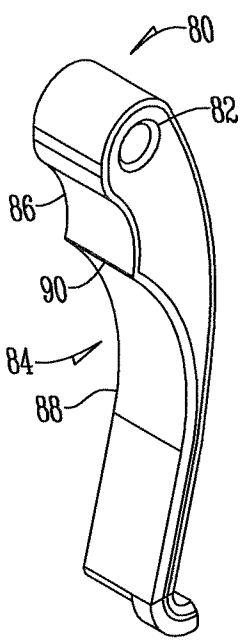
Fig. 7

FLUID DELIVERY DEVICE IDENTIFICATION AND LOADING SYSTEM

CROSS REFERENCE TO RELATED APPLICATION

This application claims the benefit of U.S. Provisional Application Ser. No. 61/426,348 filed Dec. 22, 2010, which is hereby incorporated in its entirety herein by reference.

BACKGROUND OF THE INVENTION

The present invention relates to a means of loading and unloading a pump cassette or other fluid delivery device into a medical pump.

Modern medical care often involves the use of medical pump devices to deliver fluids and/or fluid medicine to patients. Medical pumps permit the controlled delivery of fluids to a patient, and such pumps have largely replaced gravity flow systems, primarily due to the pump's much greater accuracy in delivery rates and dosages, and due to the possibility for flexible yet controlled delivery schedules. Of the modern medical pumps, those incorporating a diaphragm cassette are often preferred because they provide more accurately controlled rate and volume than do other types of pumps.

A typical positive displacement pump system includes a pump device driver and a fluid delivery device, including but not limited to a syringe, tubing, section of tubing, or a disposable cassette. The disposable cassette, which is adapted to be used only for a single patient and for one fluid delivery cycle, is typically a small plastic unit having an inlet and an outlet respectively connected through flexible tubing to a fluid supply container and to the patient receiving the fluid. The cassette includes a pumping chamber, with the flow of fluid through the chamber being controlled by a plunger or plunger activated in a controlled manner by the device driver.

One of the requirements for many pumps, including cassette pumps, is that they are able to dictate the stability and proper positioning of the fluid delivery device or cassette when loaded. The stability and proper positioning of the cassette is critical to ensure that any pump elements (including the plunger and/or sensors) that interact with the cassette are precisely aligned and positioned to accurately produce the desired output of the cassette or sense conditions related to the pump.

Previous pumps attempted to accomplish the proper positioning of the cassette by providing a molded seat that a user would manually push the cassette into. Once the cassette is forced into the molded seat, retentive snap elements engage the outer surface of the cassette to hold the cassette within the molded seat.

These previous pumps often have few if any physical elements to ensure proper cassette orientation to the pump. They rely heavily on proper loading by the operator to insure complete seating of the cassette to the pump. Additionally, they may often lack means for monitoring if the cassette was indeed oriented correctly and/or fully seated to the pump.

Other previous pumps have attempted to provide automatic cassette loaders that utilize sensors and alarms when improper cassettes are placed in the loader and to detect when the loader is not fully opened or closed. Specifically, as seen in U.S. Pat. No. 7,258,534 a processing unit is utilized in order to drive a linear actuator to position a carriage to load and unload a cassette. While effective at providing a loader that does not accept inaccurately sized cassettes, ensuring that the cassette loader is fully opened for loading, and providing an alarm if the loader is jammed or not fully closed, problems remain. Such a design is very complex, expensive, has increased maintenance issues, and can be difficult to use.

Therefore, a principal object of this invention is to provide a cost-effective medical pump having a manual loading system that provides clear, stable and proper positioning of the fluid delivery device.

A further object of the invention is to provide a medical pump that monitors proper fluid delivery device loading.

A further object of the invention is to provide a medical pump with a fluid delivery device loading system that is essentially bi-stable and thereby prevents dwelling, parking or inadvertent positioning of the fluid delivery device loading system in any position other than fully open or fully closed.

Another object of the invention is to provide a medical pump having a manual release element for manually ejecting a fluid delivery device from the pump.

Another object of the invention is to provide a medical pump with a cassette loading system having reduced complexity and power requirements.

These and other objects will be apparent to those skilled in the art.

BRIEF SUMMARY OF THE INVENTION

A medical pump includes a chassis having a fixed seat, and a carriage having a footing for receiving a fluid delivery device, including but not limited to a cassette, syringe and/or tubing, and restricting its movement. An actuator assembly moves the carriage between open and closed positions to engage the cassette or fluid delivery device to the seat. The seat establishes the position of both the carriage and fluid delivery device in the closed position.

The actuator assembly is connected to the carriage and includes a rack and pinion assembly that can be operated by rotation of a U-shaped body of the pinion assembly about a pivot axis manually with a handle or lever or otherwise. The rotation of the pinion assembly about the pivot axis causes a cam follower on the U-shaped body to move along the cam surface of a cam element mounted to the chassis. The cam surface is separated into first (upper or closing) and second (lower or opening) cam surfaces by a raised detent, apex or point of instability thereon. Thus, carriage is urged in a bi-stable manner into either a fully open position or a fully closed position. The cam element surface profile prevents dwelling of the carriage in any position other than fully open or fully closed when external force is withdrawn or withheld. One or more spring elements can interconnect the cam element or cam follower of pinion assembly with the chassis to obtain the desired carriage closing and opening force characteristics, as well as the force/torque requirements at the handle or lever. In one embodiment, a user can manually rotate the pinion assembly with an externally accessible handle to open and close the carriage.

BRIEF DESCRIPTION OF THE DRAWINGS

FIG. 7 is a perspective view of a cam element for an actuator assembly of a medical pump;

FIGS. 7A-7C present a series of side plan views of different cam elements for a bi-stable actuator assembly of a medical pump;

DETAILED DESCRIPTION OF THE PREFERRED EMBODIMENT

Figure 1:
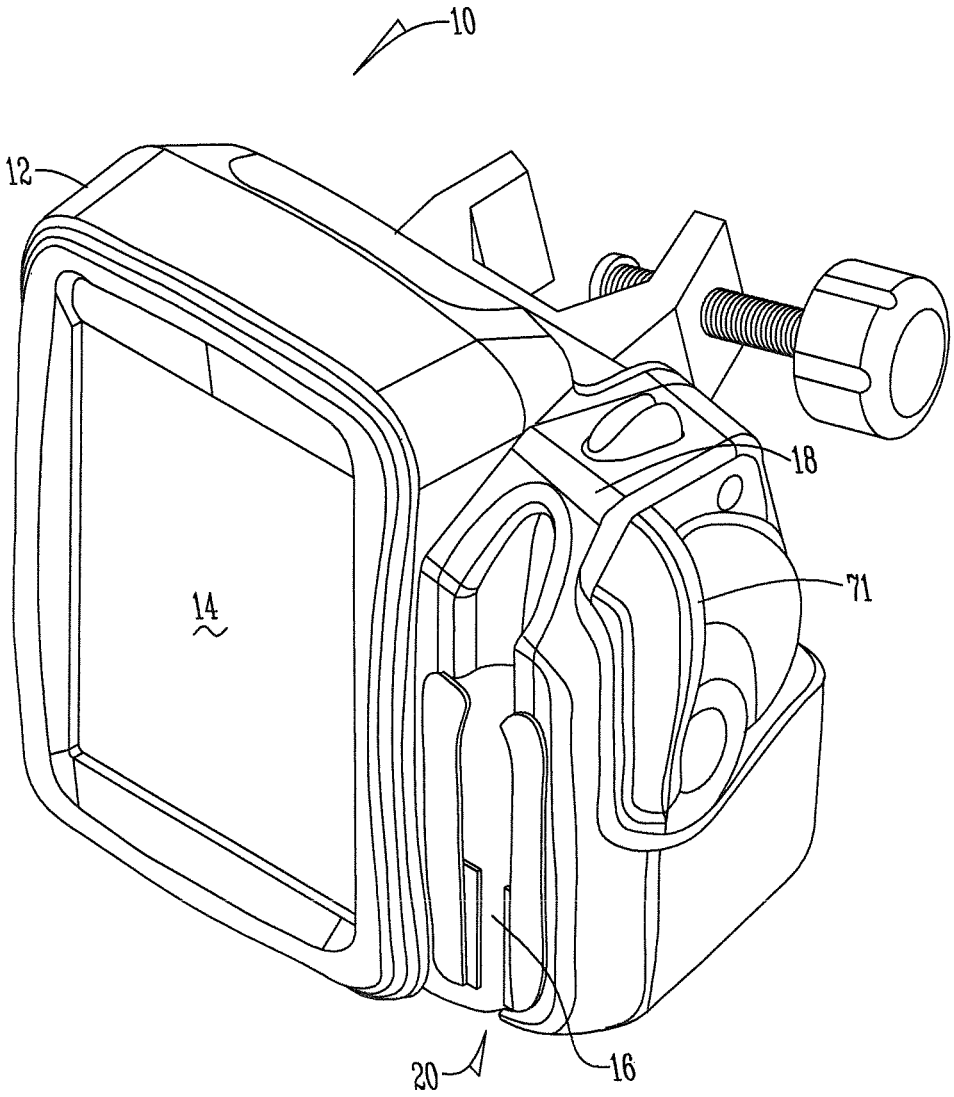
FIG. 1 is a perspective view of a medical pump.

With reference to FIG. 1 a medical pump 10 is shown having a housing 12 that houses a screen 14 and an infuser mechanism 16 attached to the housing 12. The infuser mechanism 16 includes an infusion cover 18 and a loader 20 for a fluid delivery device, including but not limited to a cassette, syringe, and/or tubing.

Figure 2:
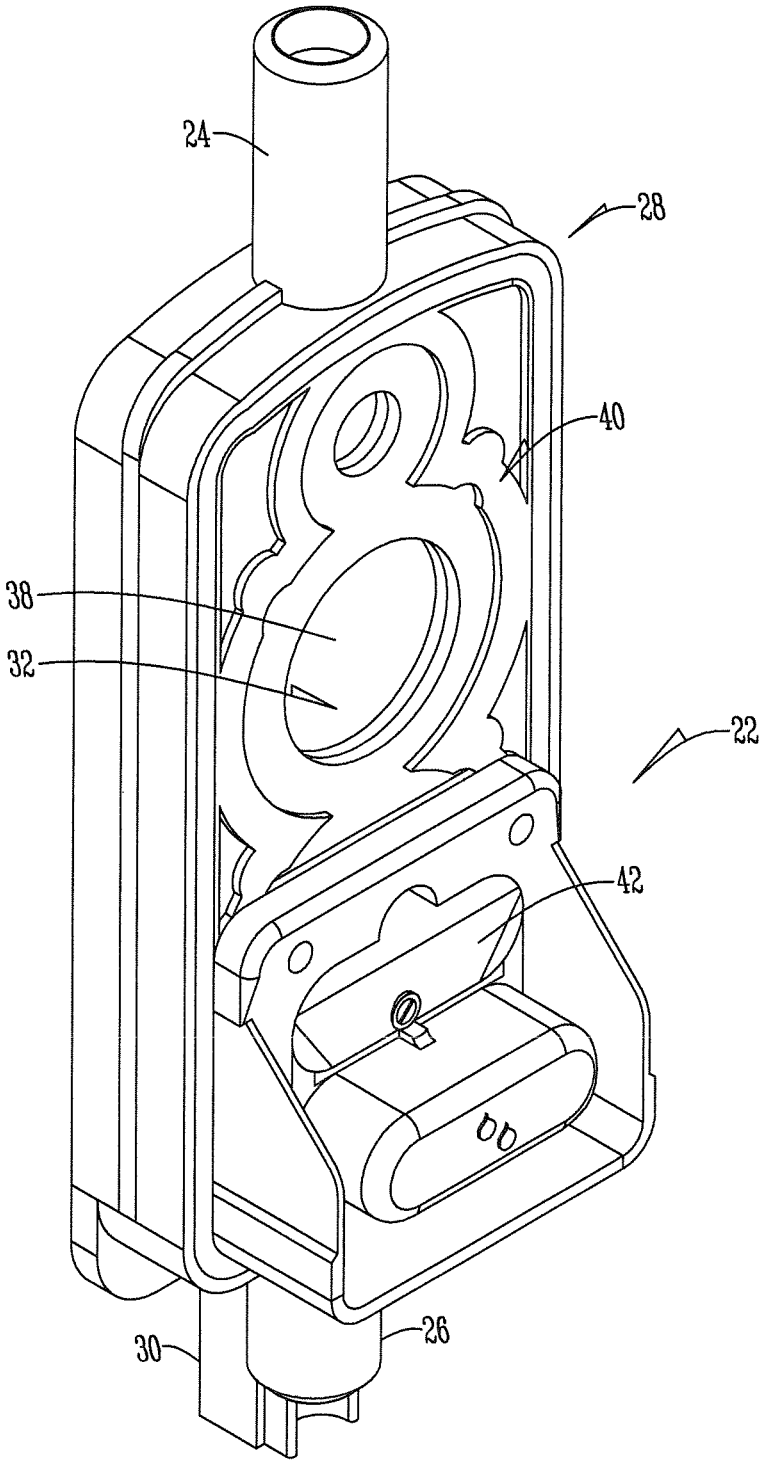
FIG. 2 is a perspective view of a cassette.
Figure 3:
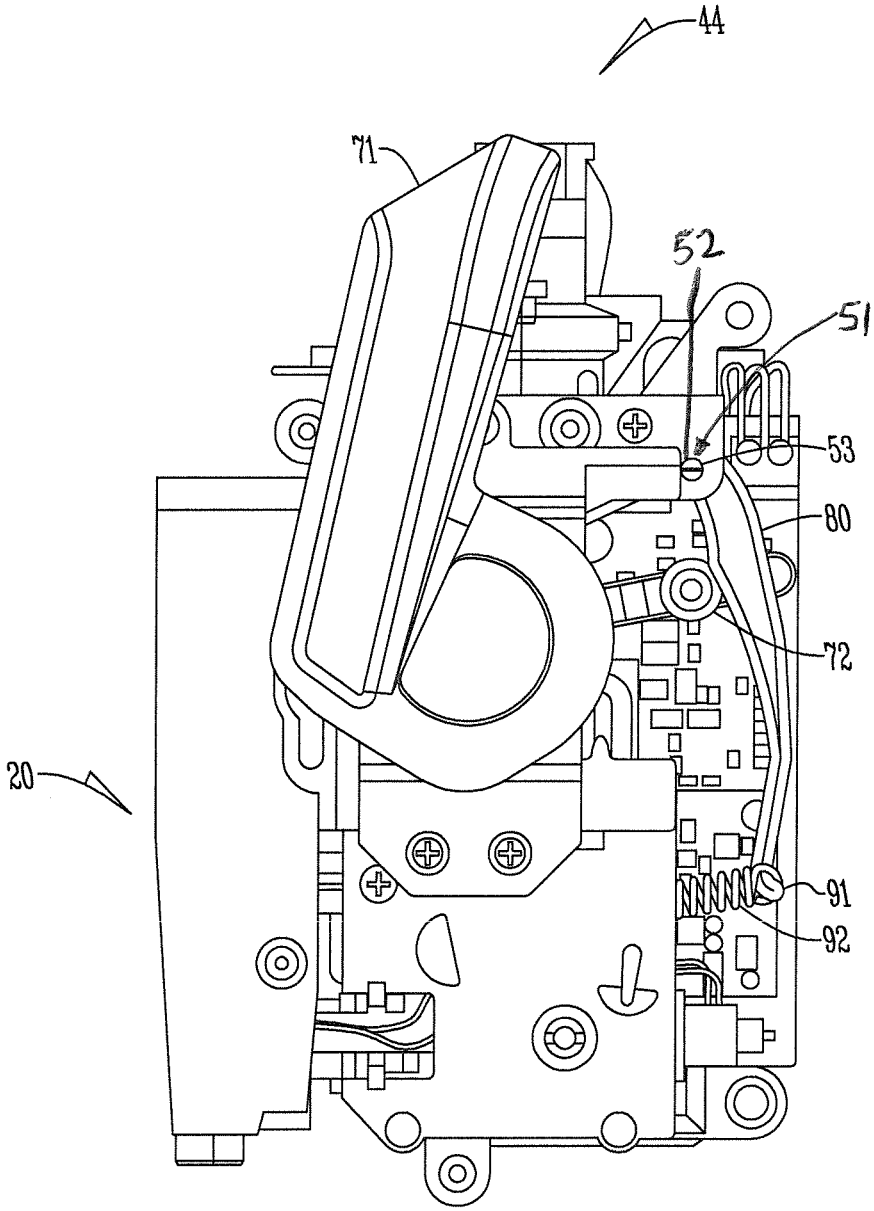
FIG. 3 is a cut-away side plan view a medical pump.

With reference to FIG. 2, one fluid delivery device, such as a cassette 22, suitable for use with the present invention is shown. The cassette 22 includes an inlet 24 and an outlet 26 formed in main body 28. Attached to the outlet 26 is a tube support element 30 for ensuring that tubing (not shown) connected to the outlet 26 is maintained in a proper position with respect to external sensors (not shown).

An elastomeric membrane 32 forms a diaphragm that extends over a pumping chamber 38 located between the inlet 24 and outlet 26 on an inner face 40 of the main body 28.

In operation, fluid enters through the inlet 24 and is forced through outlet 26 under pressure. The fluid is delivered to the outlet 26 when the pump 10 displaces the pumping chamber 38 to expel the fluid. During the intake stroke the pump 10 releases the pumping chamber 38, and the fluid is then drawn through the inlet 24 and into the pumping chamber 38. In a pumping stroke, the pump 10 displaces the pumping chamber 38 to force the fluid contained therein through the outlet 26. Thus, the fluid flows from the cassette 22 in a series of spaced-apart pulses rather than in a continuous flow. The fluid is delivered to the patient at a pre-set rate, in a predetermined manner, and only for a particular pre-selected time or total dosage.

A flow stop 42 is formed as a switch in the main body 28 and protrudes from the inner surface 40. This protrusion forms an irregular portion of the inner surface 40 which can be used to align the cassette 22 as well as monitor the orientation of the cassette 22. The flow stop 42 provides a manual switch for closing and opening the cassette 22 to fluid flow when the cassette is not installed in the pump 10. Once the cassette 22 is properly loaded, seated or installed in the pump 10, the pump controls in a conventional manner the positioning of the flow stop 42 and thus the delivery of fluid through the cassette 22.

Figure 4:
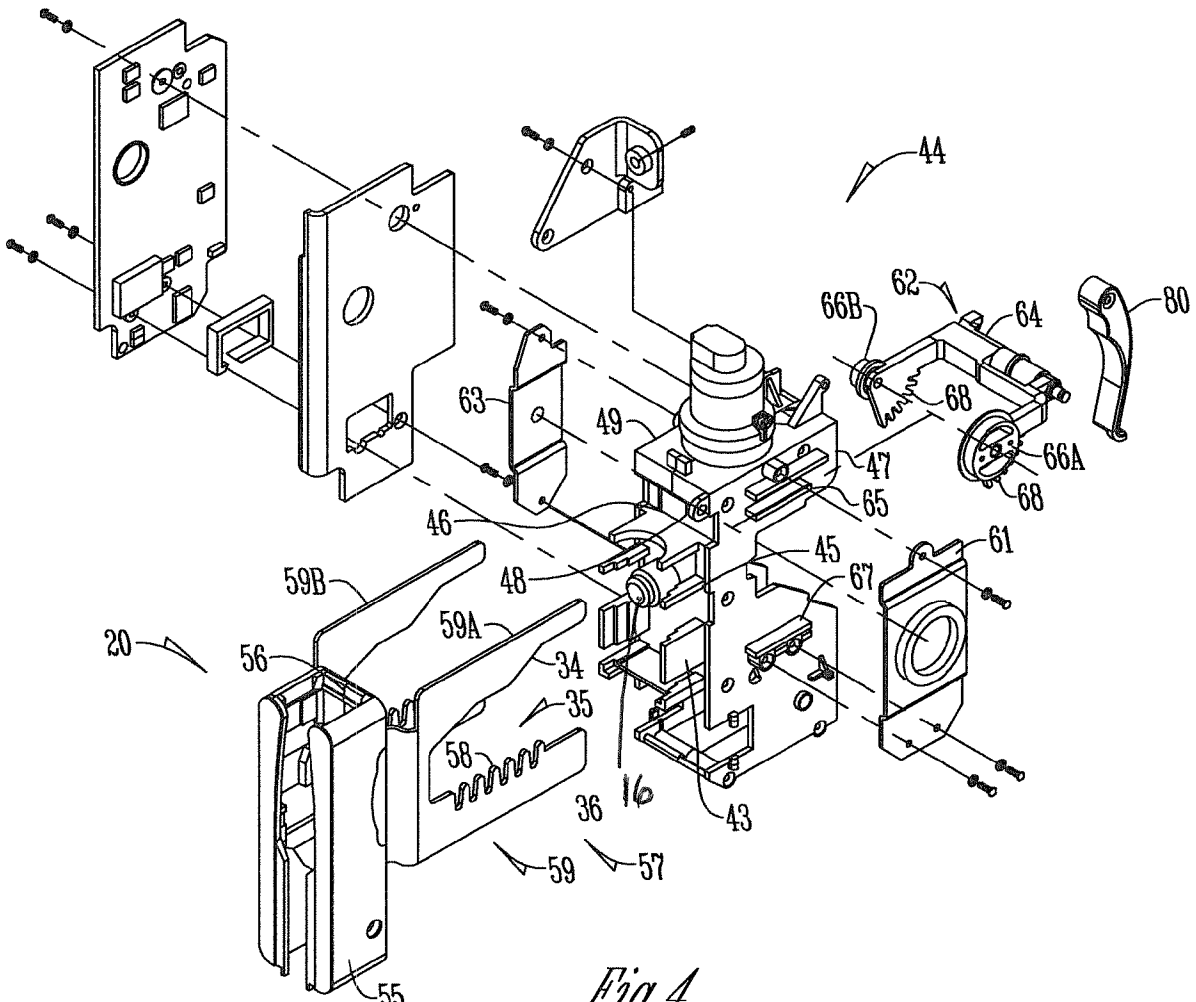
FIG. 4 is an exploded assembly view showing the construction of a loader actuator assembly for a medical pump.
Figure 5A:
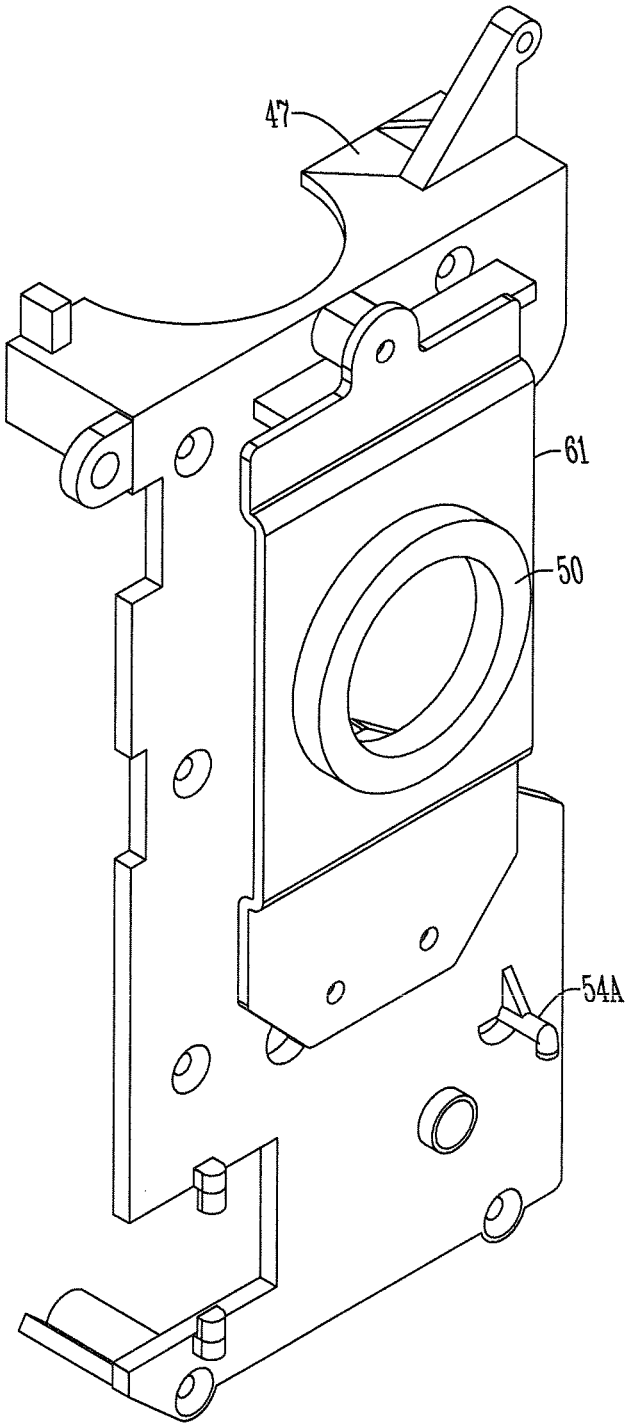
FIG. 5A is a frontal perspective view of a chassis side plate for a medical pump.
Figure 5B:
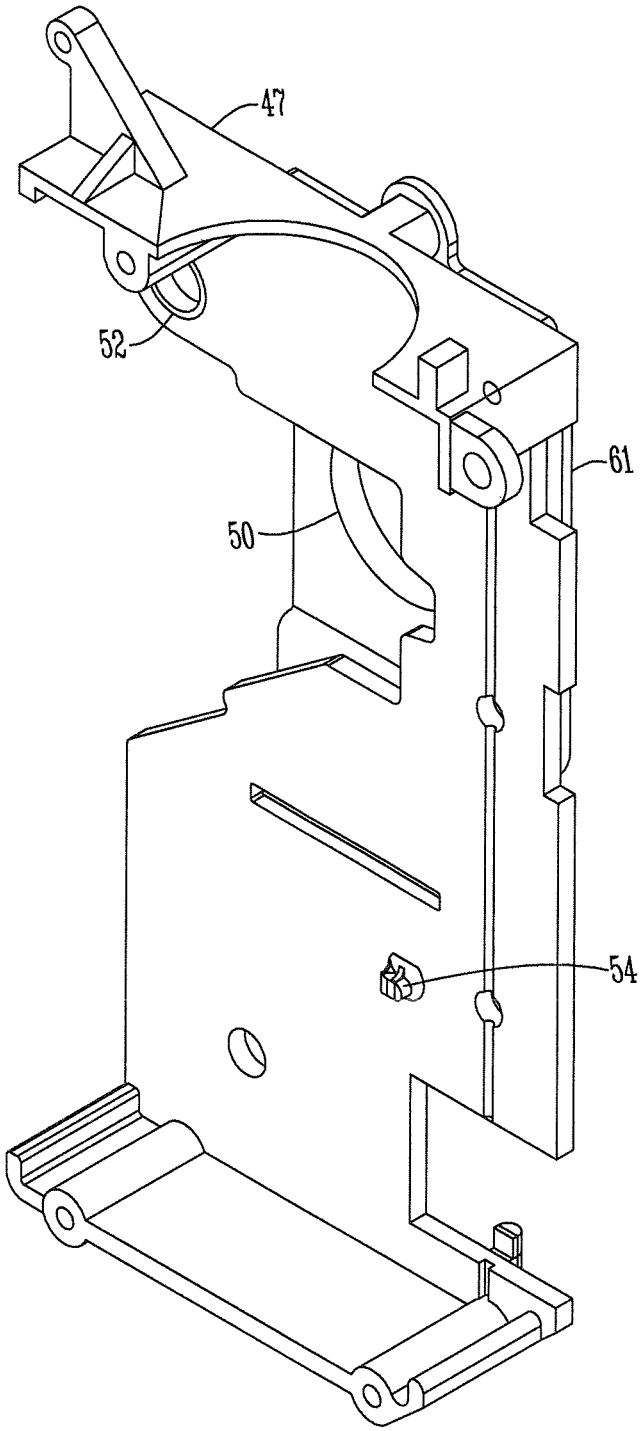
FIG. 5B is a rear perspective view of the chassis side plate from FIG. 5A.
Figure 5C:
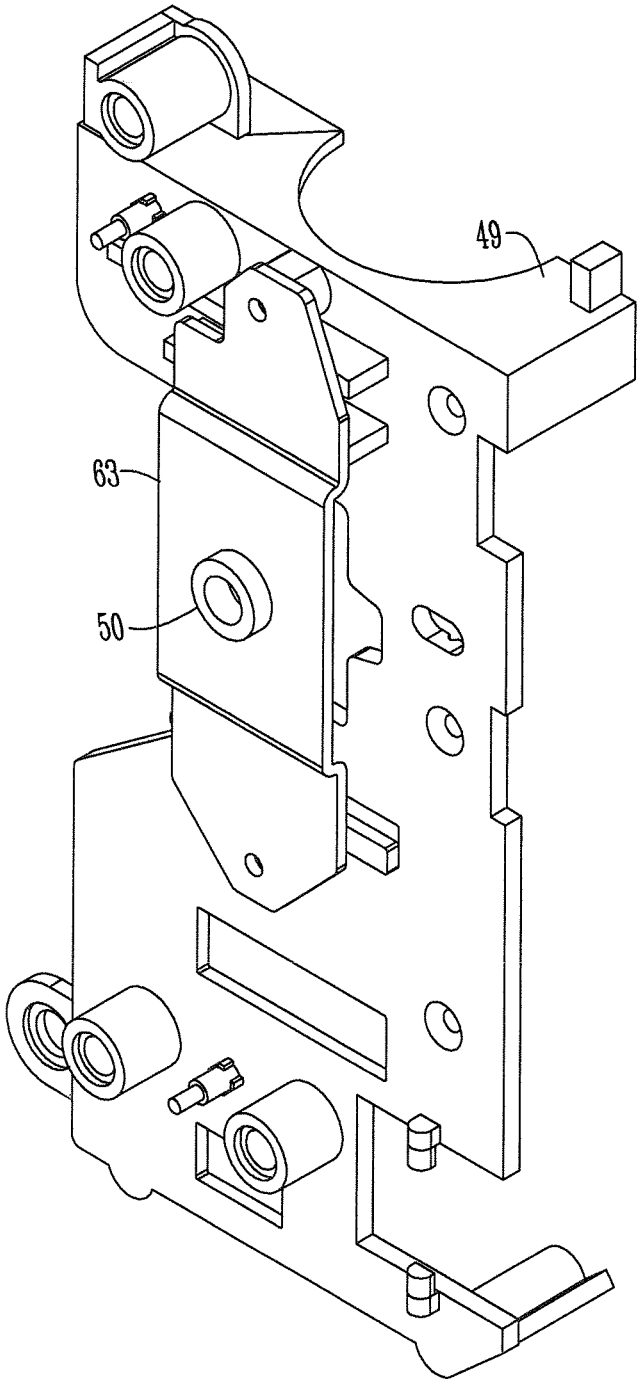
FIG. 5C is a frontal perspective view of another chassis side plate for the medical pump.
Figure 5D:
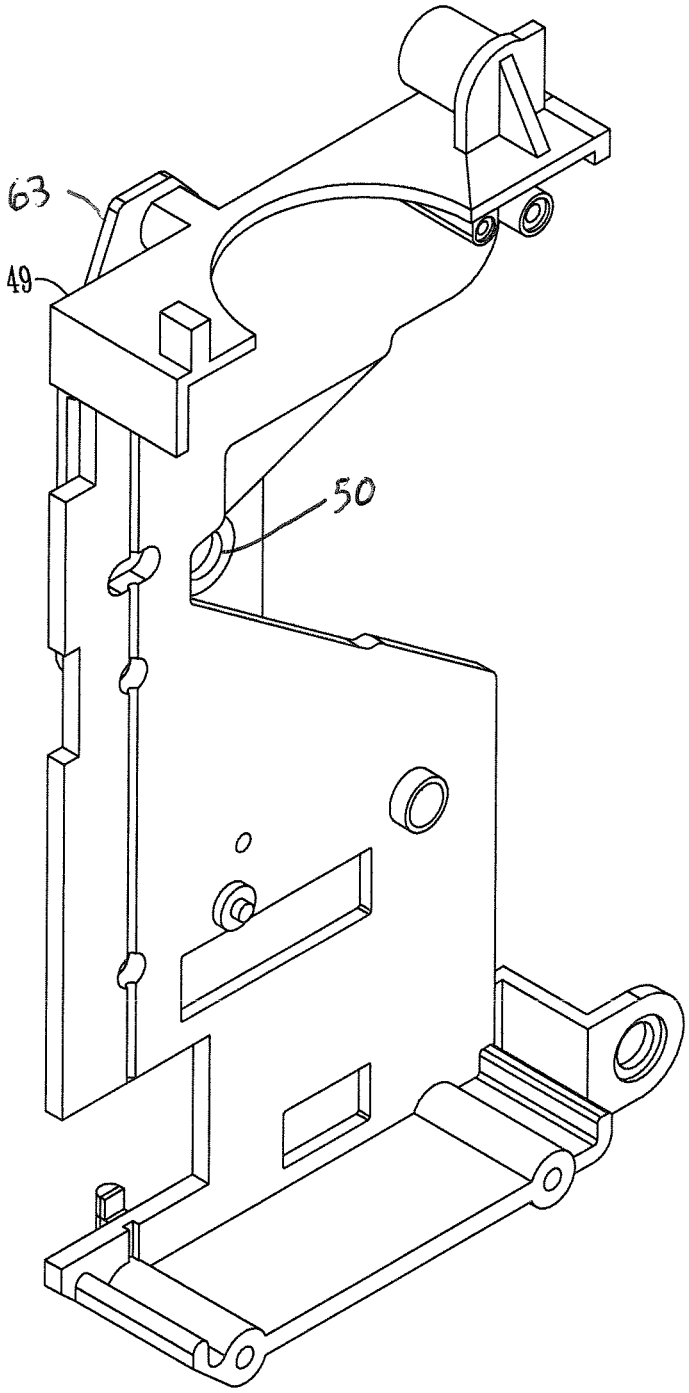
FIG. 5D is a rear perspective view of the chassis side plate from FIG. 5C.

As best shown in FIGS. 3-13 the loader 20 has an actuator assembly 44 that includes a chassis 46 that supports the components of the actuator assembly 44. The chassis 46 is best seen in FIG. 4 and comprises a main body 48 and a pair of side chassis members 47, 49. Each of the side chassis members 47, 49 includes a bearing 50, a pivot member 51, which can be a pivot pin 53 or a pivot receptacle 52 that receives a pivot pin 53 (FIGS. 3 and 5B) depending on the configuration of the mating components, and optionally an anchor 54.

The actuator assembly 44 additionally has a carriage 56 that is connected to the chassis 46 and has an opening therein that is adapted to receive the cassette 22. The opening forms a footing that restricts movement of the cassette within the carriage 56. U.S. Pat. No. 7,258,534 that is incorporated in its entirety herein describes the carriage 56, the cassette receiving opening and footing in greater detail, how fascia 55 surrounds and is connected to the carriage 56 and slide plates, and explains how a cassette 22 is loaded into a carriage 56. As disclosed therein, the carriage 56 is movable inwardly with respect to the chassis 46 from an open position wherein the carriage 56 is spaced from a fixed seat 43 on the chassis 46 to a closed position to engage the cassette 22 to the fixed seat 43. The fixed seat 43 on the chassis 46 is formed by one or more finger elements 45 extending horizontally and outwardly from a vertical base surface located on the front of the chassis 46.

In operation the cassette 22 is inserted into a top opening of the front carriage assembly, when the loader 20 is in the open position. Upon insertion, the cassette 22 slides into the carriage 56 and is loosely secured in place and supported by the footing on the carriage. The carriage 56 is movable from an open position horizontally inwardly with respect to the chassis 46 to a closed position to engage the cassette 22 to the fixed seat 43.

In one embodiment of the present invention the actuator assembly 44 includes a rack element 57 connected to the carriage 56. The rack element 57 has a plurality of teeth 58 and optionally can include written indicia associated with the teeth 58 to indicate the position of the carriage 56 with respect to the chassis 46.

As best understood in view of FIG. 4, the teeth 58 of rack element 57 can be formed or provided on a single U-shaped mounting bracket 59 that straddles the chassis 46. Alternatively, the teeth 58 can be formed or provided on one or more mounting brackets of a pair of spaced apart individual substantially upright mounting brackets 59A, 59B that have one end connected to the carriage 56 and an opposite end that projects away from the carriage 56 and generally inwardly toward the chassis 46. The brackets 59, 59A, 59B are mounted to the chassis 46 so as to move the carriage 56 inwardly and outwardly with respect to the chassis 46. Although many carriage movement paths or trajectories are possible without departing from the invention, in one embodiment the arrangement of the mounting brackets 59, 59A, 59B is designed to move the carriage 56 at least horizontally, and more preferably linearly.

In one embodiment the mounting brackets 59, 59A, 59B extend between the side chassis members 47, 49 and a bearing plate 61, 63 that mounts to the side chassis members 47, 49 and includes the bearing 50. In such an embodiment, the brackets 59, 59A, 59B have an upper arm 34 and a lower arm 36 that define an opening 35 therebetween and extend from a central portion that is connected to the carriage 56. The opening 35 is sized and shaped so as to provide clearance that allows for the predetermined, anticipated or desired range of movement of the carriage 56 with respect to the chassis 46. Separate bearing plates 61, 63 and clearance in the rear of the chassis 46 and side chassis members 47, 49 allow assembly of most of the actuator assembly 44 after the carriage 56 is put in place and brought into engagement with the fixed seat on the chassis 46. In one embodiment guide members 65, 67 are mounted or formed on one or more of the side chassis members 47, 49 or the bearing plates 61, 63 to guide the mounting brackets 59, 59A, 59B during their movement with respect to the chassis 46. The use of a lower guide member 67 also provides a support surface on which the movable brackets 59, 59A, 59B can slide.

Figure 6:
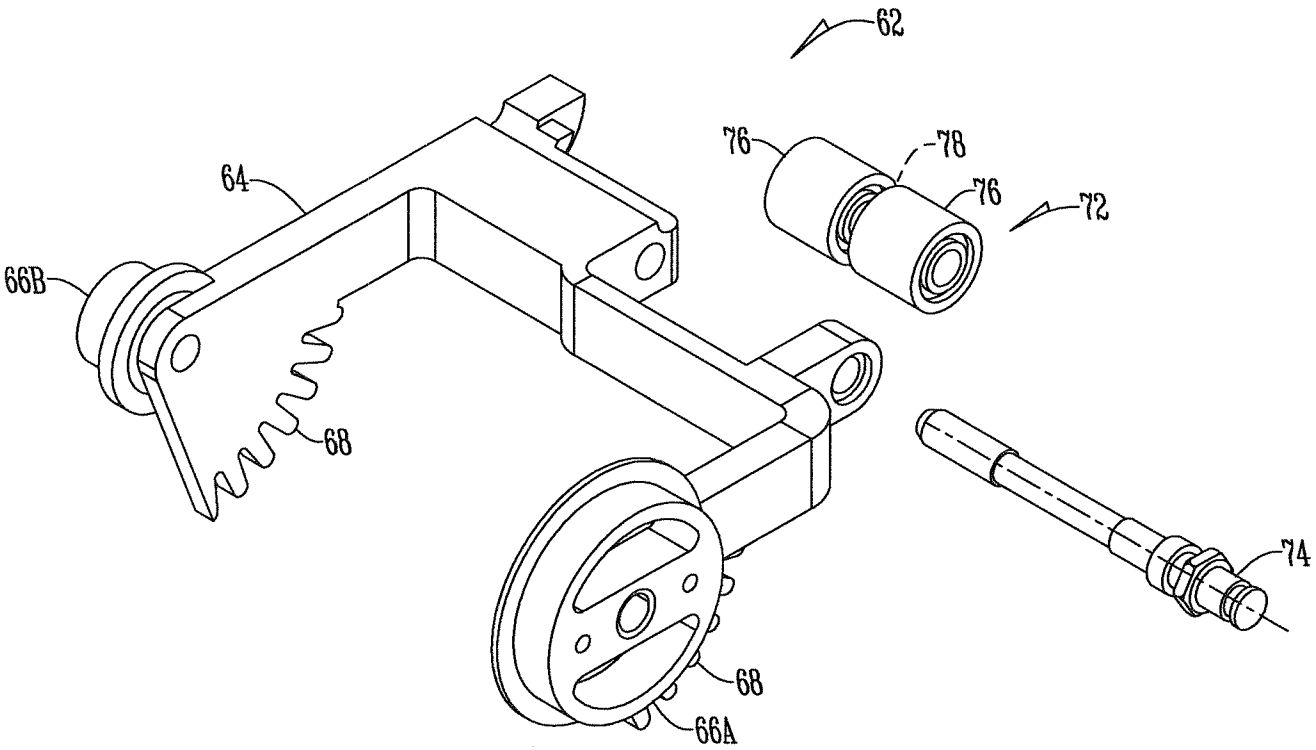
FIG. 6 is an exploded assembly view of a pinion assembly of an actuator assembly for a medical pump from FIG. 4.
Figure 8:
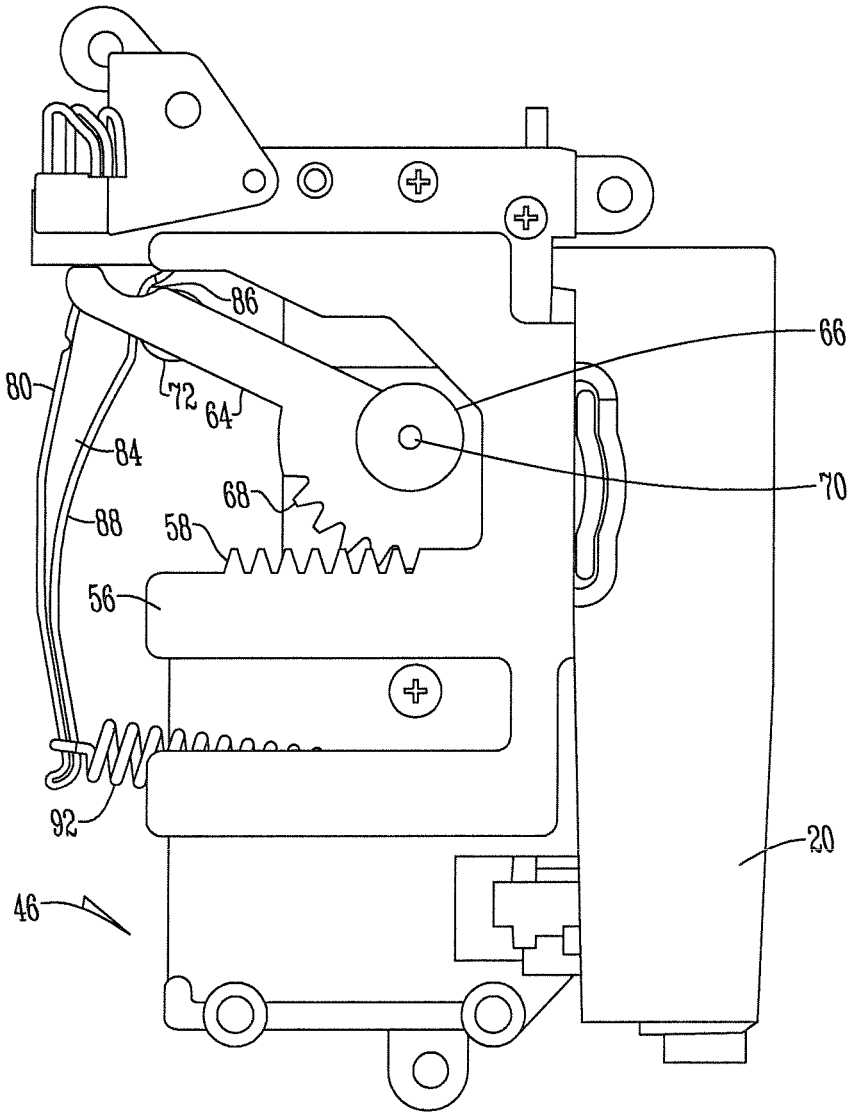
FIG. 8 is a side cut-away plan view of a medical pump wherein an actuator assembly has a door and carriage thereon positioned in a closed position against a seat on the pump chassis.

The actuator assembly 44 additionally includes a pinion assembly 62 that is best seen in FIGS. 4 and 6. The pinion assembly 62 includes a generally U-shaped body 64 having a pivot element 66 comprising pivot members 66A, 66B received within the bearings 50 connected to the chassis to provide rotational movement of the pinion assembly 62 with respect to the chassis 46. The pinion assembly 62 also has a plurality of teeth 68 that mesh with the teeth 58 of the carriage 56 such that as the teeth 68 of the pinion assembly 62 move along the teeth 58 of the chassis 46 the U-shaped body 64 pivots about a pivot axis 70. At least one pivot member 66A is attached to a handle 71 that causes rotation of the U-shaped body 64 about the pivot axis 70 when actuated. The pinion assembly 62 additionally includes a cam follower 72 that in one embodiment may be attached with a pin 74 and contains one or more roller bearings 76 and optionally one or more O-rings 78 mounted on or sandwiched between the roller bearings 76 to provide additional friction and improve traction of the cam follower 72. In another embodiment the pinion assembly 62 is die cast as a unitary one-piece body wherein the U-shaped body 64 includes the cam follower 72.

The actuator assembly 44 additionally comprises a cam element 80 as best shown in FIG. 7. The cam element 80 is pivotably attached to one or more of the side chassis members 47, 49 of the chassis 46 by the pivot member 51. In the embodiment shown in FIGS. 3 and 4, a pivot pin 53 extends through the pivot receptacle 52 and through an opening 82 on the cam element 80. As illustrated by FIGS. 7A-7C respectively, the opening 82 can be formed at a nominal, high or low location to vary the rotational pivot point of the cam element 80 and thereby the distance between the pivot point and the detent 90 as shown. Since the stackup or summation of tolerances of the components of the actuator assembly 44 may vary considerably as determined by their individual tolerances, a selective assembly method (choosing of the most appropriate cam element at final assembly) can be utilized to ensure that the desired opening and closing forces are consistently obtained despite the variations caused by other components. Cam element 80 has a cam surface 84 that includes first and second surfaces 86 and 88 that converge at a raised detent 90. In the depicted embodiment the cam surfaces 86 and 88 are arcuate as shown, but other profiles such as linear or flat planar are possible. The cam follower 72 of the pinion assembly 62 engages the cam surface 84 of the cam element 80 in order to urge or bias the carriage 56 toward the closed position when the cam follower 72 engages the first arcuate section 86 and to urge or bias the carriage 56 to an open position when engaging the second arcuate section 88. The cam element 80 may optionally include an anchor 91 in the form of a hook, hole or slot. The presence of the raised detent 90 or apex at the intersection of the surfaces 86 and 88 on the cam surface 84 results in an actuator assembly 44 that is essentially bi-stable and ensures that the cassette loader 20 is prevented from being parked or left in a partially open or partially closed position. When the handle 71 is used to rotate the pinion assembly 62 such that the cam follower 72 moves along either of the cam surfaces 86 or 88 toward the detent 90, the handle 71 and the associated loader 20 tends to return to its beginning stable position (with the loader either fully open or fully closed) if the force on the handle is withdrawn. Also, when the force or torque on the handle 71 and thereby the pinion assembly 62 reaches a predetermine threshold, the cam follower 72 is pushed over the detent 90 and the actuator assembly 44 tends to snap quickly into its alternative stable position (fully closed or fully open).

Figure 12:
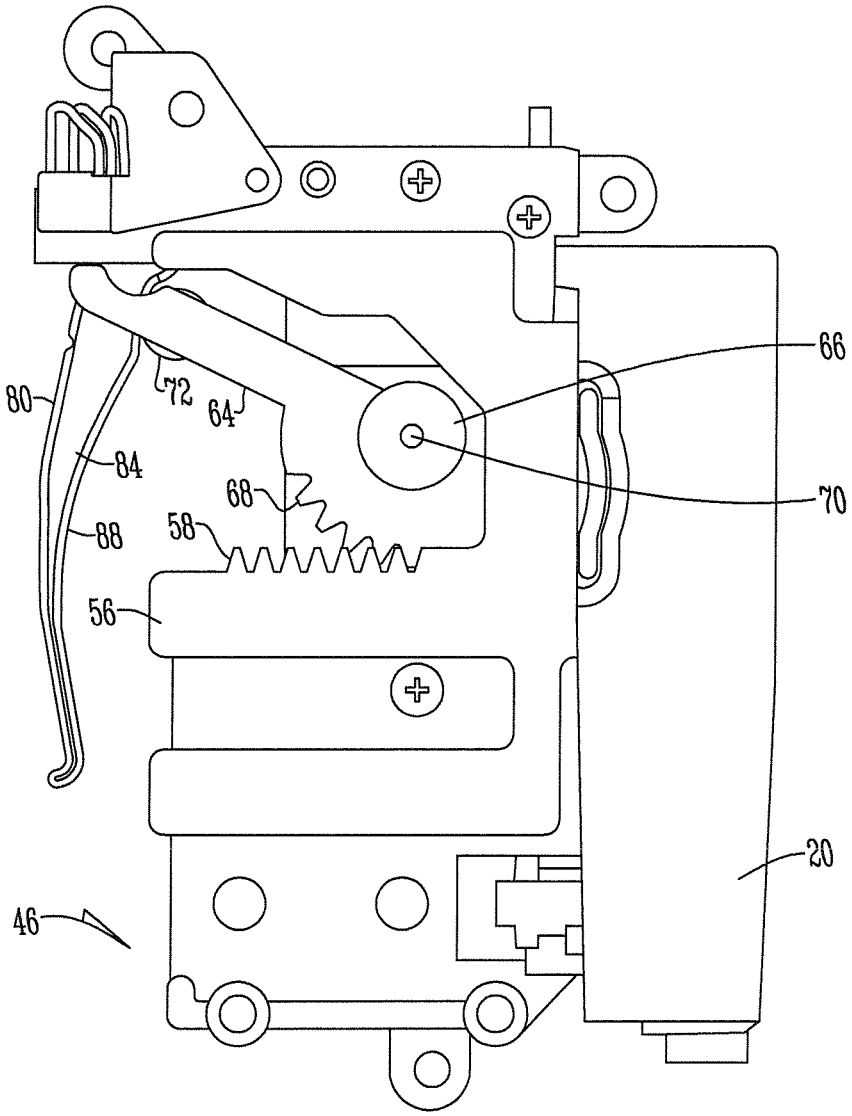
FIG. 12 is a side cut-away plan view of a medical pump with another alternative embodiment of a spring element and wherein an actuator assembly has a door and carriage thereon positioned in a closed position against a seat on the pump chassis.
Figure 13:
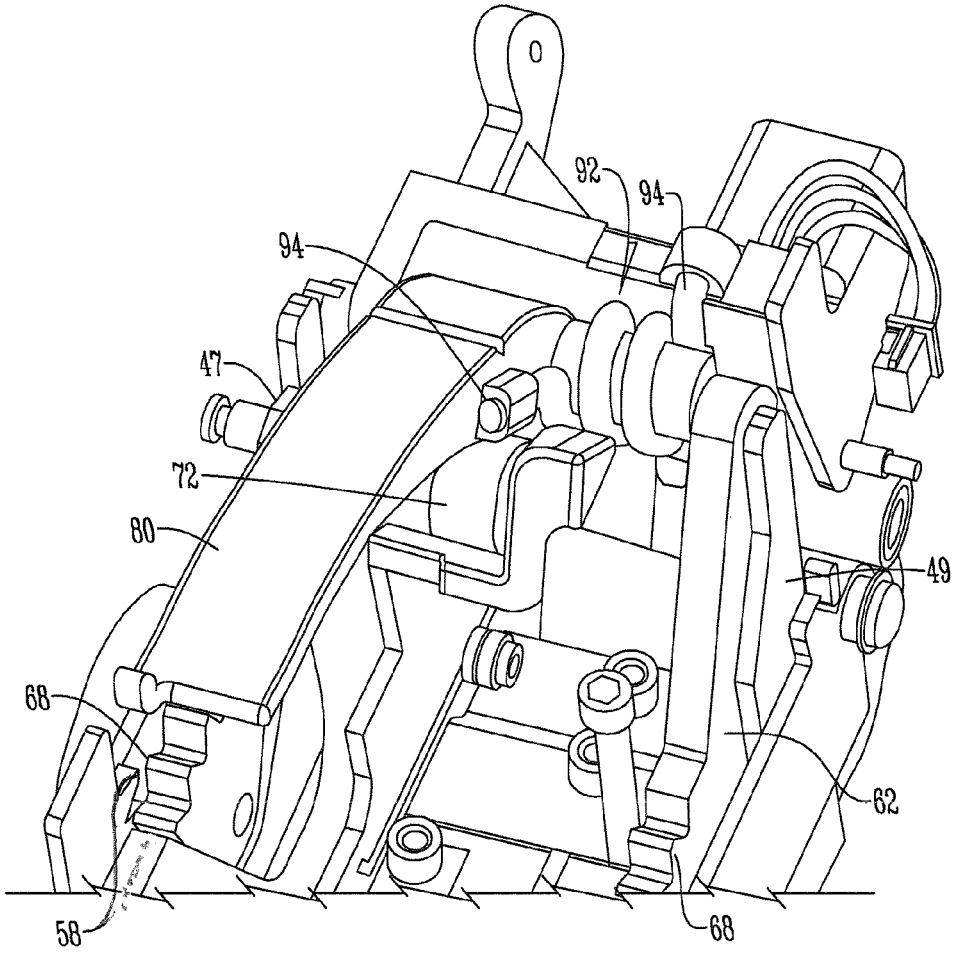
FIG. 13 is a perspective view of a rear portion of the actuator assembly of the medical pump of FIG. 12.

As shown in FIGS. 3 and 8-13, the actuator assembly 44 has at least one spring element 92 that is used to bias the cam element 80 into engagement with the cam follower 72 and generally toward the carriage 56 that holds the cassette 22. In one embodiment (FIGS. 3 and 8-9) a tension spring is used and connected to the end of the cam element 80 opposite the opening 82 and attached at another end to the anchor 54 on the chassis 46 or to another location on the chassis 46 or actuator assembly 44. As shown in FIGS. 3 and 10-13, one way of connecting an end of the spring element 92 to an end of the cam element 80 is with the anchor 91, which in this particular embodiment is shown as a hook. Alternatively, in another embodiment shown in FIGS. 10 and 11, the spring element 92 is a compression spring that has one end retained by or attached to a post or socket (not shown) on the end of the cam element 80 opposite opening 82. The spring element 92 has another end that may be retained by or attached to another fixed position or structure other than the chassis 46 or actuator assembly 44, such as a post or socket (not shown) on the housing 12. Alternatively, as shown in FIGS. 12-13 the spring element 92 may be a torsion spring having tang elements 94 that directly or indirectly engage the cam element 80 and the chassis 46 to bias the cam element 80 into engagement with the cam follower 72 and generally toward the carriage 56 that holds the cassette 22.

Figure 14:
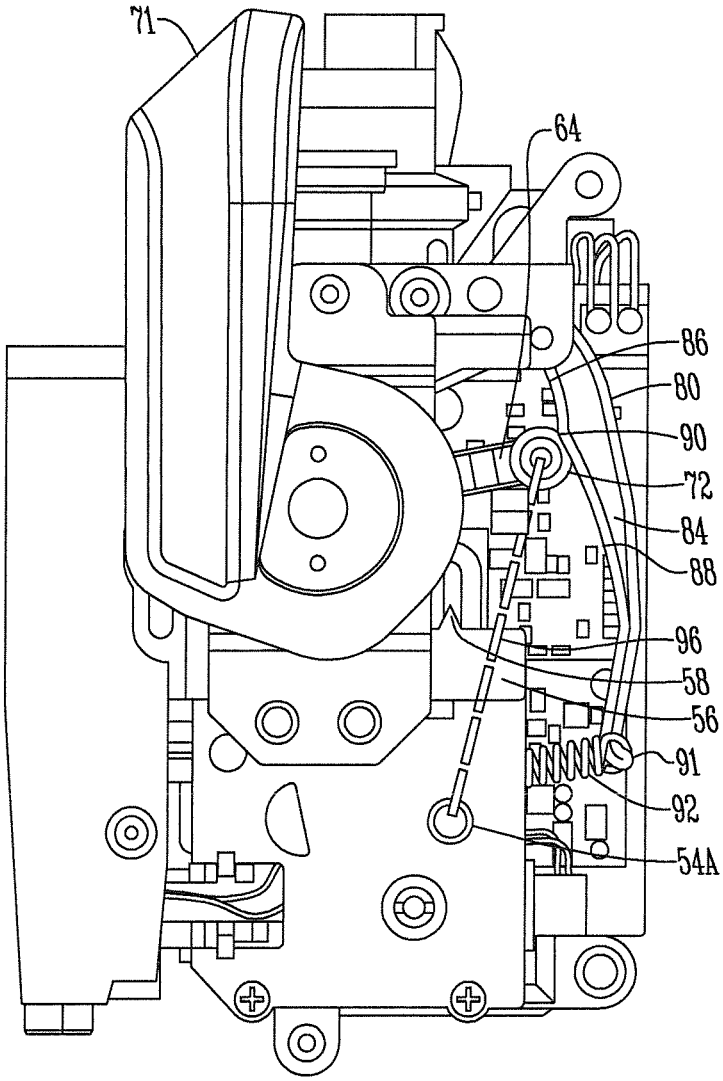
FIG. 14 is a side cut-away plan view of another embodiment of a loader actuator assembly for a medical pump that uses a second spring element to further mitigate the chance of parking the assembly anywhere but the fully open or fully closed positions.
Figure 15:
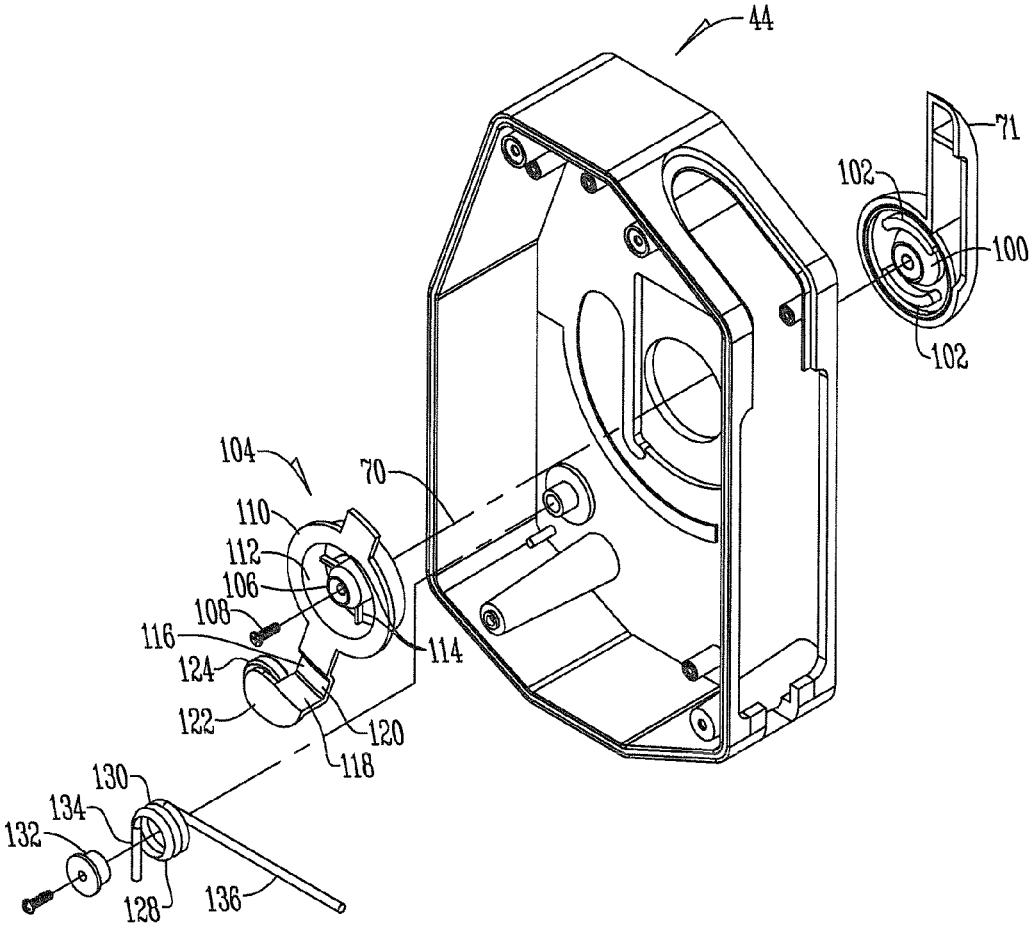
FIG. 15 is an exploded assembly view showing the construction of an alternative embodiment of the loader actuator assembly.
Figure 16:
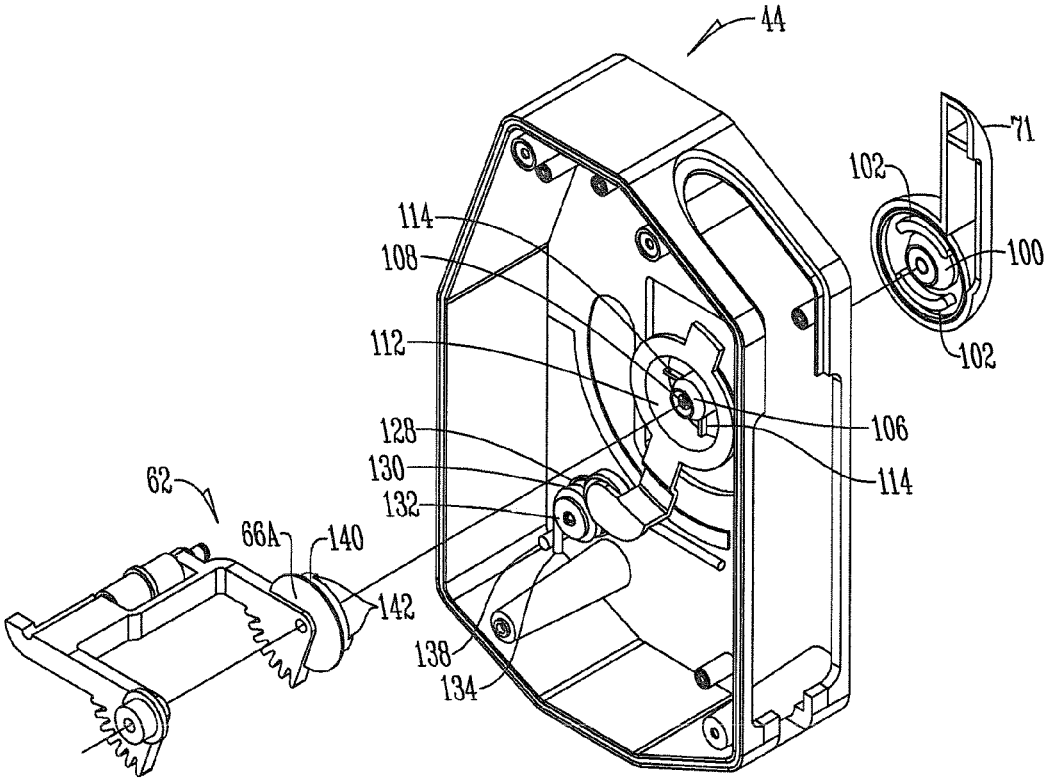
FIG. 16 is an exploded assembly view showing the construction of an alternative embodiment of the loader actuator assembly in a closed position.
Figure 17:
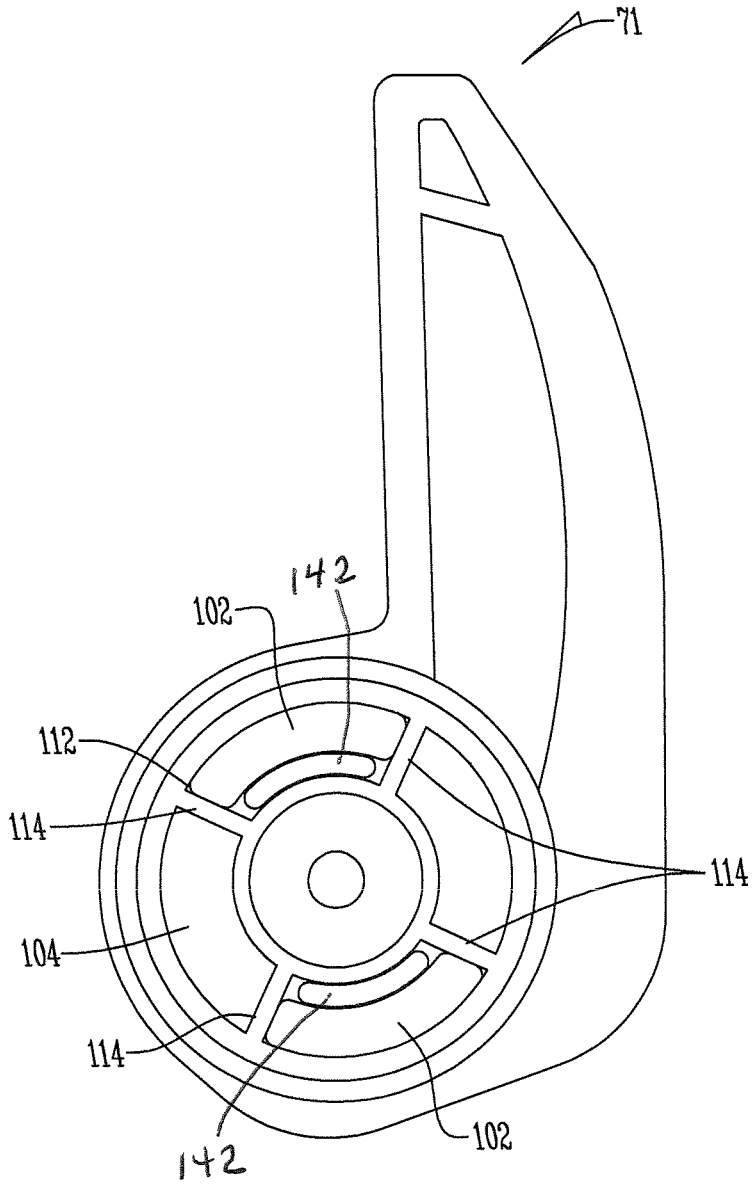
FIG. 17 is a side cut-away view of a handle of an alternative embodiment of the loader actuator assembly in a closed position.
Figure 18:
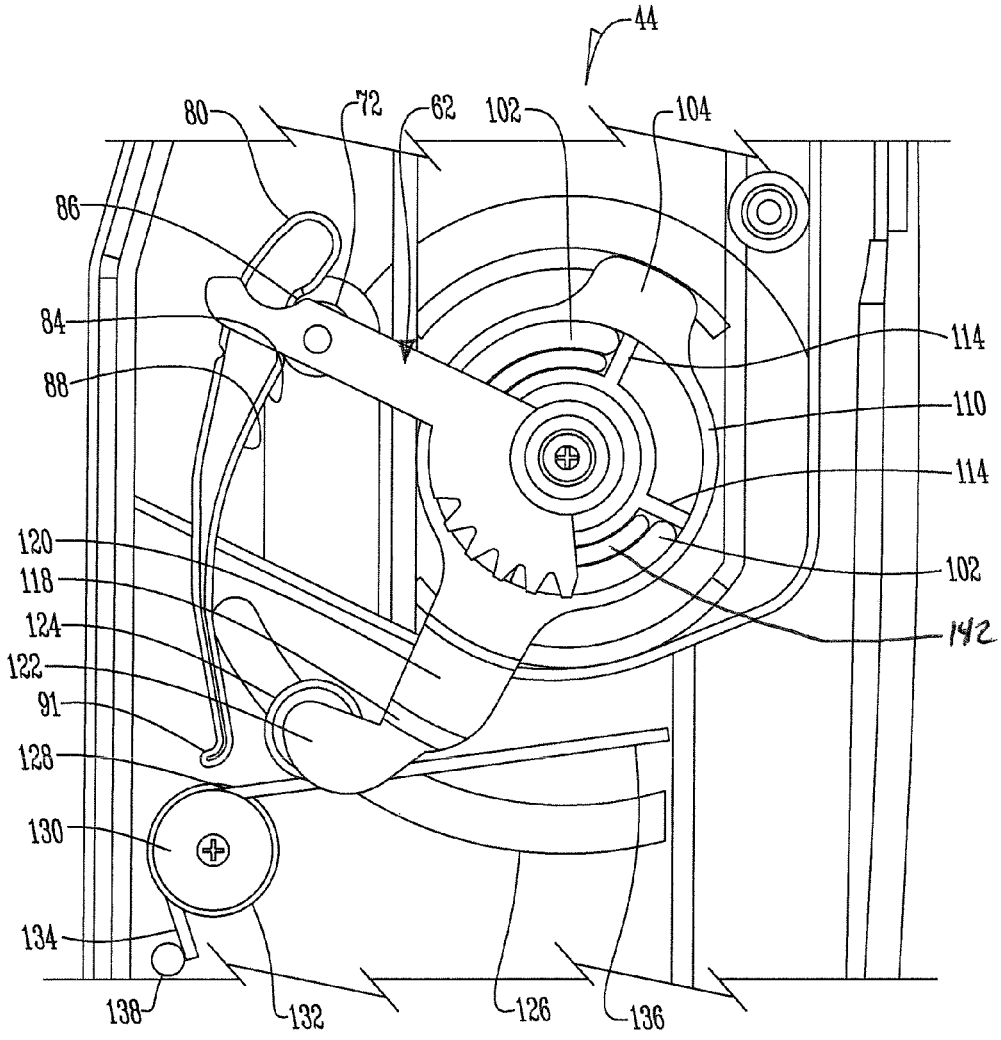
FIG. 18 is a cut-away side plan view of an alternative embodiment of the loader actuator assembly.
Figure 19:
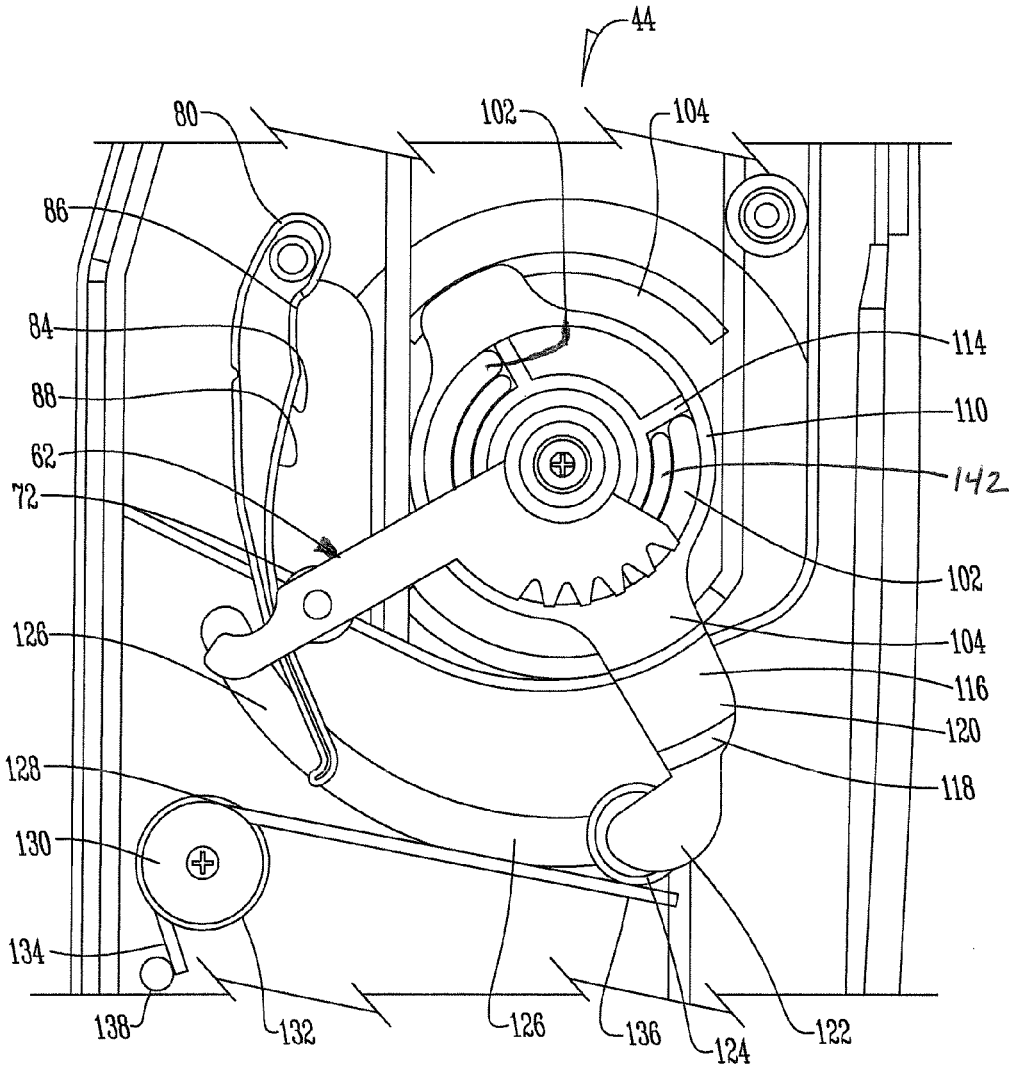
FIG. 19 is a side cut-away view of a handle of an alternative embodiment of the loader actuator assembly in an open position.

In addition, more than one spring element 92 operatively connected to the cam element and working in concert or opposition with another may be used to provide biasing force and provide the desired open and closing force characteristics or torque requirements for the loader 20 or the handle 71. See FIG. 14, which shows a second spring element 96 added to the actuator assembly 44. The second spring element 96 has one end connected to the rear of the U-shaped body 64, more preferably to the pin 74 of the cam follower 72. The other end of the spring element 96 is connected to the chassis 46 via an anchor 54A on the side chassis member 47 (see FIG. 5A, too). Thus, the second spring element 96 lacks a direct connection to the cam element 80 and thus is independent of the cam element 80. In the embodiment shown the second spring element 96 exerts a force that is independent of the cam element 80 and always tends to open the loader 20. It will also be appreciated that the user could push on the loader 20 to close it rather than using the handle 71. However, the user must use the handle 71 to open the loader 20.

Because of the unique design of the actuator assembly 44, in the absence of any externally applied force, the actuator assembly 44 always presents a minimum clamping force of more than 7 lbs. to keep the carriage 56 in a closed or fully closed position and a force of about 1 lb. to keep the carriage 56 in an open or fully open position. Somewhere in the range of 5-10 lbs. of external force needs to be applied to overcome the biasing force of the actuator assembly 44 and move the carriage 56 from a nominally open position to the transition point where the cam follower 72 is at the detent 90. The force required gradually increases as the carriage 56 or the handle 71 is moved inwardly until the cam follower 72 reaches the detent 90 on the cam element 80. Once the detent 90 is traversed, the biasing force of the actuator assembly 44 switches from resistance to assistance and provides a clamping force that moves the carriage 56 to the closed position and maintains it there. In the closed position, the actuator assembly 44 clamps the carriage 56 closed so that the cassette 22 engages the fixed seat on the chassis 46. In this position, the initially closed flow stop 42 and the cassette 22 are under the control of the infuser mechanism 16 of the pump 10. The actuator assembly 44 stops or resists further movement of the carriage 56 at the opened and closed positions and prevents externally initiated movement from being stopped between the opened and closed positions. If the external forces are withdrawn during the inward movement of the loader 20 prior to the traversing of the detent 90, the loader 20 will be urged to return to the open position. If the external forces are withdrawn during the opening of the loader 20 prior to the traversing of the detent 90, the loader 20 is likewise urged to return to or stay in the closed position. Thus, the carriage 56 can only stop, rest or dwell in a fully opened or fully closed position, thereby ensuring that the carriage 56, and thus cassette 22, is not parked or left in a different position. In this manner the carriage 56 cannot be left in a position close to but not quite in the fully closed position wherein flow stop 42 might be inadvertently bumped open causing free flow to a patient without realization of a user. Instead, the carriage 56 can only be stopped in the fully open and fully closed positions such that an individual using the medical pump 10 does not use the medical pump at a time that the cassette 22 is not properly installed and positioned within the pump 10. The loading system also identifies and prevents an unauthorized or improper cassette from being loaded. An unauthorized, incorrect or improperly shaped cassette cannot be fully loaded because it will be physically blocked from reaching the fully closed position and thus the carriage 56 will return to the fully open position where the user will realize the error and remove the improper cassette.

In operation, with reference to FIGS. 8-14, when the carriage 56 is in a closed position as seen in FIGS. 8, 10, 12 and 14, the cam follower 72 engages the first arcuate section 86 of the cam element 80. At this time and at all times, the spring element 92 urges the cam element 80 into engagement with the cam follower 72 and toward the carriage 56. Because the cam follower 72 is engaging the first arcuate section 86 a force acting on the U-shaped body 64 of the pinion assembly 62 causes the U-shaped body and the pinion assembly 62 to want to rotate about the pivot axis 70 so that the teeth 68 exert an inwardly pulling carriage force on the meshed teeth 58 of the carriage mounting brackets 59, 59A, 59B, thus providing a force on the carriage 56 to stay at the fully closed or closed position. Thus, the cassette 22 is clamped against the fixed seat on the chassis 46 and pump delivery or fluid flow through the cassette 22 is permitted only as controlled by the infuser or pumping mechanism 16 of the pump 10.

As an individual manually or otherwise moves the carriage 56 or rotates the lever 71, the cam follower 72 moves along the first arcuate surface 86 to the detent 90 to place the system in a neutral but unstable detent position. At the detent position the force from the cam element 80 is normal to the pivot axis 70 resulting in a balance with the other forces in the system that neither urges the teeth 68 of the pinion assembly 62 to pull or push on the teeth 58 of the carriage mounting brackets 59, 59A, 59B. Instead, because the force from the cam element 80 is normal to the axis, no inherent internal rotational force exists on the pinion assembly 62. However, because the detent 90 is formed as a raised apex, it is unlikely for the cam follower 72 to dwell there.

Figure 9:
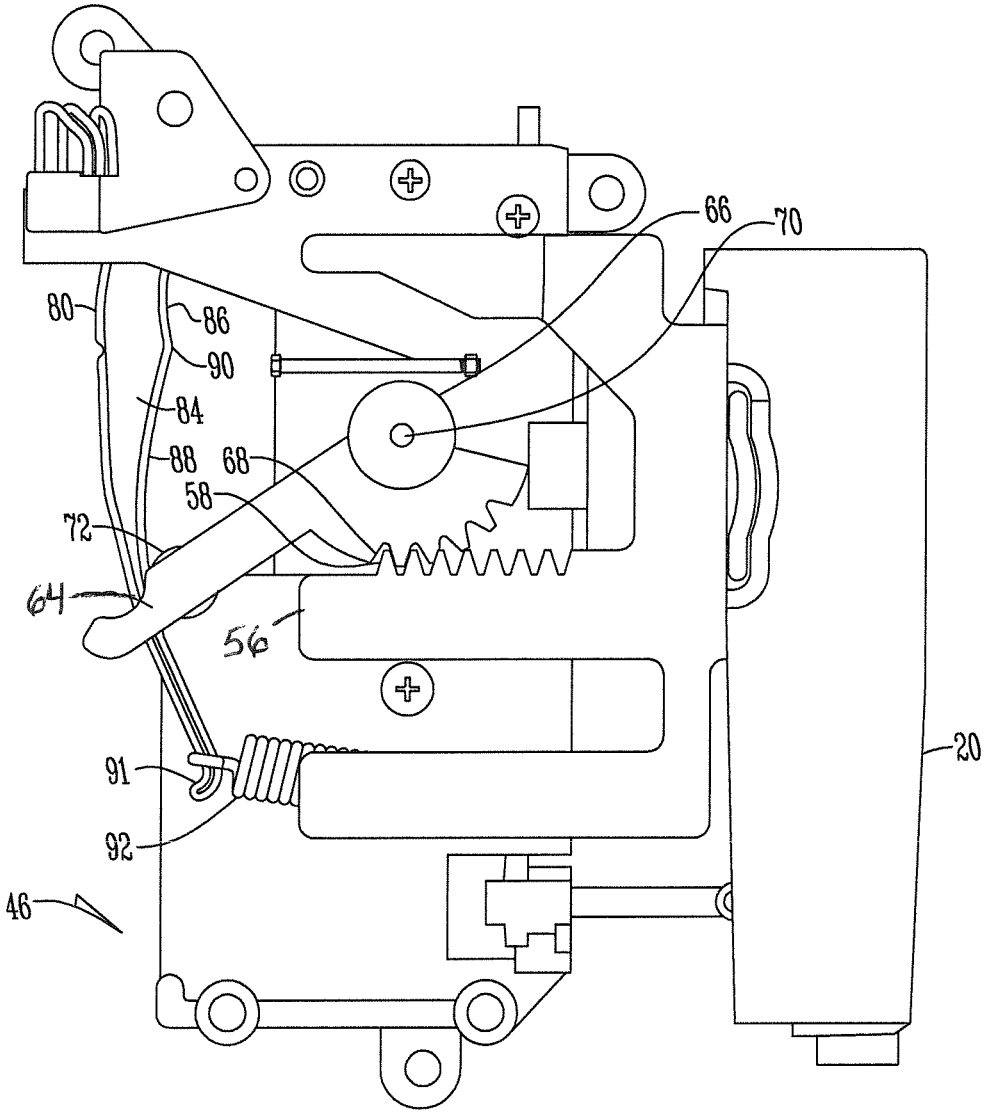
FIG. 9 is a side cut-away plan view of a medical pump similar to FIG. 8 except the actuator assembly has a door and carriage thereon positioned in an open position outwardly spaced from a seat on the pump chassis.
Figure 10:
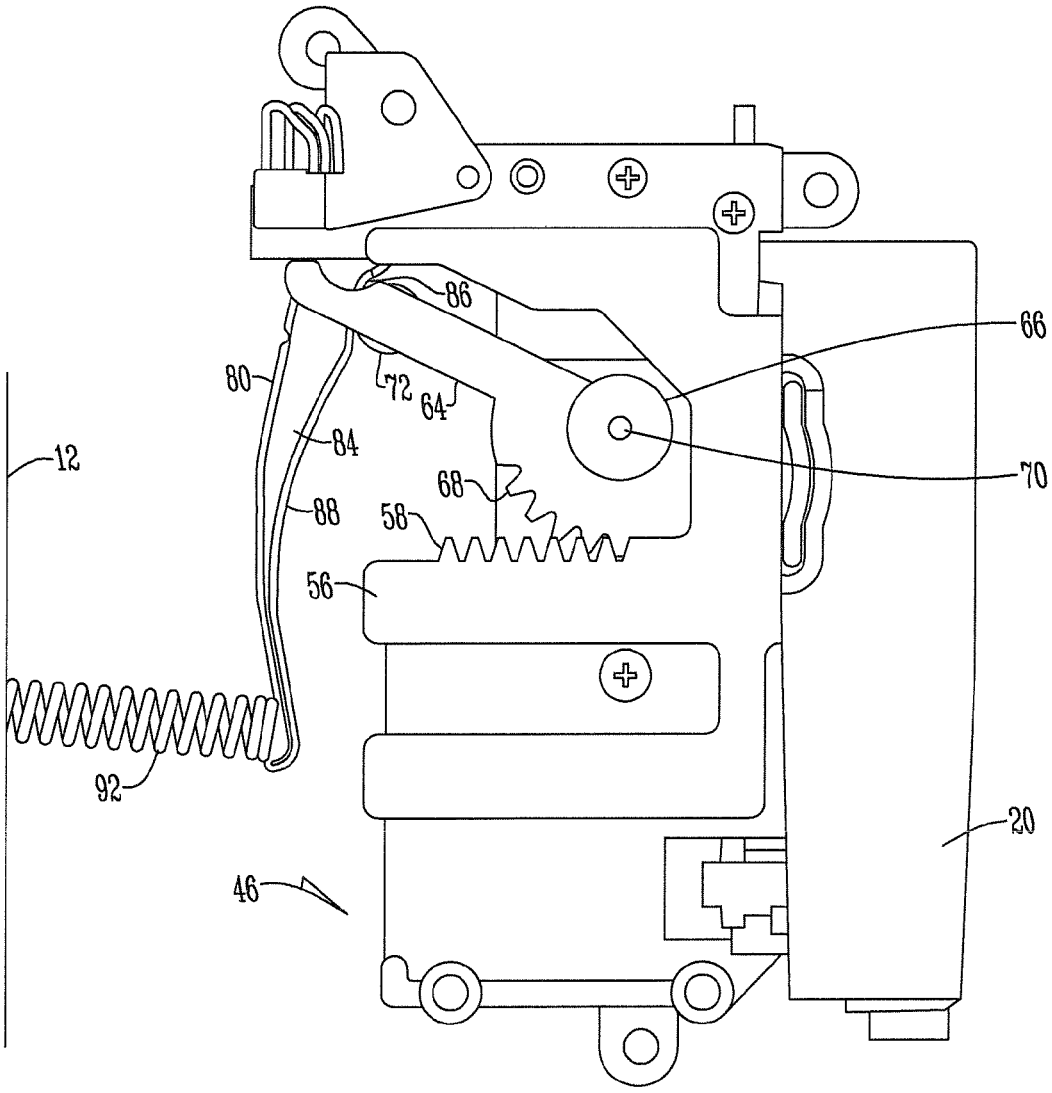
FIG. 10 is a side cut-away plan view of a medical pump with an alternative embodiment of a spring element and wherein an actuator assembly has a door and carriage thereon positioned in a closed position against a seat on the pump chassis.
Figure 11:
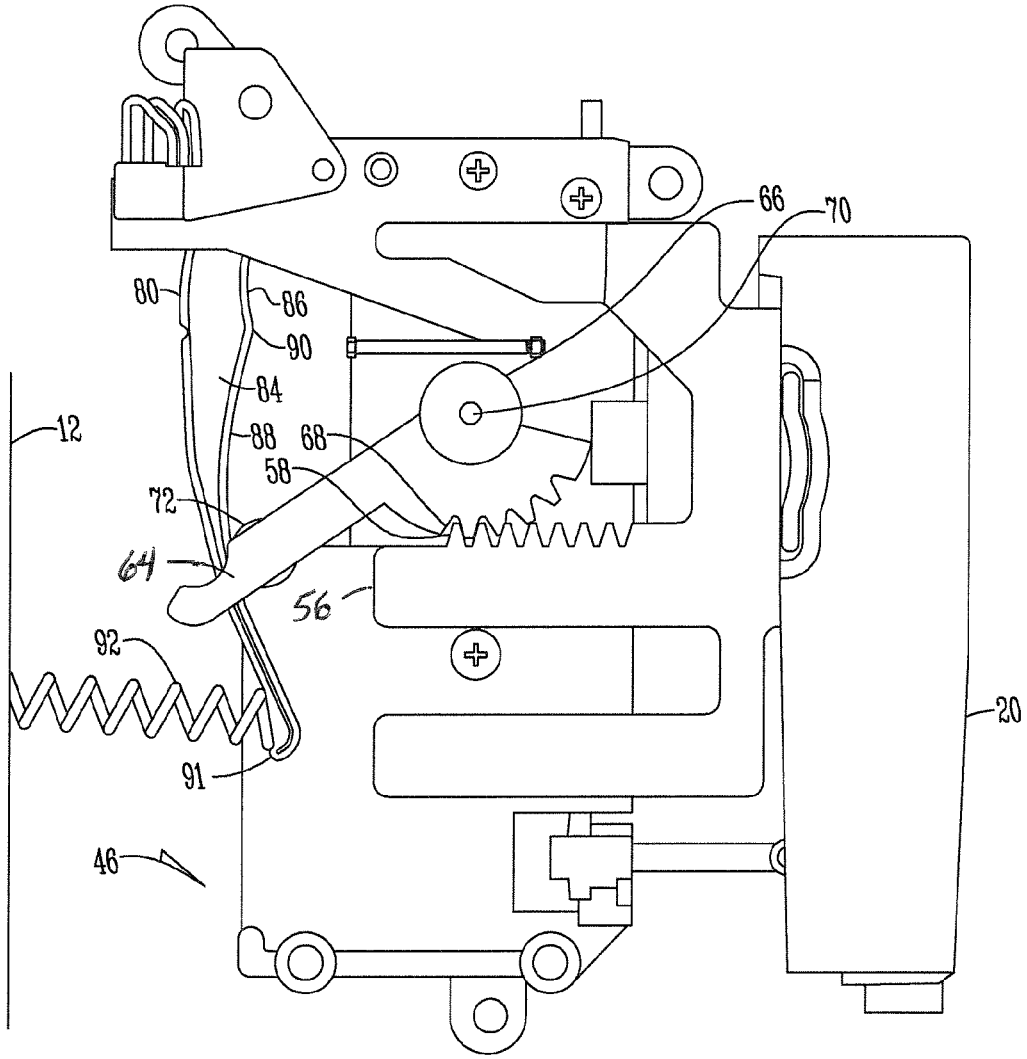
FIG. 11 is a side cut-away plan view of a medical pump similar to FIG. 10 except the actuator assembly has a door and carriage thereon positioned in an open position outwardly spaced from a seat on the pump chassis.

When the cam follower 72 moves to the second arcuate section 88 of the cam surface 84, as shown in FIG. 9, the spring force of spring element 92 through the cam element 80 creates a force urging the pinion assembly 62 to rotate in an opposite direction about the pivot axis 70 so that the teeth 68 push the mounting brackets 59, 59A, 59B via the teeth 68. This in turn moves the carriage 56 outwardly from the chassis 46 and urges the carriage 56 to the fully open position. The flow stop 42 can be returned to the closed position by the infuser mechanism 16 before the loader 20 opens, thus preventing fluid flow.

Once a cassette 22 is installed in the carriage 56 of the loader 20 the handle 71 is then rotated causing the cam follower 72 to move along the cam surface 84 from the second arcuate section 88 to the detent 90. Once the cam follower 72 overcomes the detent 90 and begins moving along the first arcuate section 86 of the cam element 80 the rotational force about axis 70 changes to a force urging the carriage 56 to the closed position. In this manner the actuator assembly 44 urges and holds the carriage 56 in the fully opened and fully closed positions and prevents the carriage from stopping at a position that is not either fully opened or fully closed.

FIGS. 15-19 show yet another embodiment of the actuator assembly 44. In this embodiment the handle 71 has a journal 100 that is aligned along and rotates about pivot axis 70 of the pinion assembly 62. Spaced around the centrally located journal 100 radially are a pair of engagement members 102 that in a preferred embodiment are arcuate in shape and protrude toward the housing 12 in spaced relation to the journal 100.

Handle 71 is received within the bearing 50 of the infusion cover 18 of the housing 12 by a lever bearing 104. Lever bearing 104 similarly has a journal 106 that is centrally located and aligns with the journal 100 of the handle 71 such that a fastening member 108 is threadably received through the journal 106 by the journal 100 to secure the handle 71 to the lever bearing 104.

The lever bearing 104 has a rounded main body 110 that has aligned openings 112 separated by spokes 114. The openings 112 are spaced about the journal 106 and receive the engagement members 102 such that when the lever bearing 104 is secured to the handle 71 the engagement members 102 are within the openings 112. The openings 112 are of size and shape to have a greater circumference than the engagement members such that the engagement members 102 can rest within the openings 112 without engaging the lever bearing 104. In this manner the handle 71 is rotated from about 5 degrees to 10 degrees before engaging the spoke 114 of the lever bearing 104 in order to cause rotation of the lever bearing 104.

The lever bearing 104 additionally has a tongue element 116 extending from the main body 110 downwardly and forming a flange 118 that extends away from an arcuate section 120 of the tongue element 116 such that the flange 118 extends toward the interior of the housing 12. Finally, the tongue widens to a rounded end section 122 that angles downwardly from the flange 118. Attached to the end section 122 is a roller element 124 that is guided by a bearing element 126 in the interior of the housing 12. In the embodiment shown, the bearing element 126 is a raised rail formed arcuately on an interior surface of the cover 18 of the housing 12. The bearing element could also be an arcuate slot in the cover 18 that guides a pin on which the roller element 124 is mounted.

Additionally within the cover 18 of the housing 12 a spring element 128 having a coil 130 mounted on a hub element 132 secured to the housing 12. The spring element 128 additionally has first and second tang elements 134 and 136 where the first tang element engages a stop element 138 secured to the housing 12 and the second tang element 136 is an elongated member having a length longer than the first tang element 134 and received within a groove 123 (not shown) on the roller element 124 such that the roller element 124 is guided along the second tang 136 as the lever bearing 104 is rotated about the pivot axis 70.

In the embodiment of FIGS. 15-19 the pinion assembly 62 is modified such that the first pivot member 66A has a guide member 140 extending therefrom with dual arcuate flanges 142 in a parallel spaced relation extending toward the handle 71. The guide member 140 has a central opening that receives the journal 106 of the lever bearing 104 such that the arcuate flanges 142 are received within the openings 112 in side-by-side inward radially adjacent relation to the engagement members 102.

When rotating the handle 71, the handle can be rotated from about 5-10 degrees before the arcuate flanges 142 engage the spokes 114 of the lever bearing 104. After this the lever bearing 104 continues to rotate such that the spokes 114 engage and rotate the arcuate flanges 142 of the pinion assembly 62. During the initial "lost motion" rotation of the handle 71, the second tang 136 resists the motion of the handle 71 as the roller element 124 moves along the tang 136. In this manner the handle 71 is not urged toward the opened position unless overcoming more than a mere nominal force on the lever that can be created as the result of cleaning the lever 71 and housing 12 during routine maintenance of the pump 10. As the pinion assembly 62 rotates the pinion assembly 62 interacts with the cam element 80 as discussed above in order to open and close the cassette loader 20 as required.

Thus, presented is a medical pump for use with a cassette. The device has an actuator assembly that is bi-stable and arranged so as to be actuated to place the assembly in only one of a fully opened or a fully closed position. By utilizing this arrangement a manual actuator can be utilized that prevents a carriage from being parked in a position that is not either fully opened or fully closed. This eliminates instances of mistake wherein a carriage is parked in a non-closed position yet an individual believes the carriage is closed and attempts to provide medicine with the infuser or pumping mechanism 16 of the pump 10. This also helps deter a user from inadvertently changing the position of the flow stop 42 on the cassette 22 during loading and unloading. In addition, the system is easy to use efficient and is more inexpensive to manufacture than automatic loaders for pumps. By only allowing a fully opened or fully closed position cassettes of only a certain predetermined size may be placed into the system to ensure that inaccurately sized cassettes that are incompatible with the medical pump are not placed into the medical pump. Thus, at the very least all of the stated objectives have been met.

It will be appreciated by those skilled in the art that other various modifications could be made to the device without departing from the scope of this invention. All such modifications and changes fall within the scope of the claims and are intended to be covered thereby.

What is claimed is:

1. A medical pump for use with a cassette, comprising:

a chassis having a fixed seat thereon;

a carriage connected to the chassis and having an opening therein adapted to receive a cassette, the opening forming a footing which restricts movement of the cassette within the carriage, the carriage being movable inwardly with respect to the chassis from an open position wherein the carriage is spaced from the fixed seat to a closed position to engage the cassette to the fixed seat; and an actuator assembly connected to the carriage having a cam element having a cam surface that is engaged by a cam follower such that as the cam follower moves along the cam surface the carriage moves between the closed position and the opened position;

wherein the cam follower is rotatably connected to a handle via a lever bearing;

wherein the lever bearing has a radial opening and a spoke and the handle has an engagement member disposed through the radial opening wherein in a first position the engagement member does not contact the spoke and in a second position when the handle is rotated the engagement member engages the spoke to rotate the lever bearing and cam follower.

2. The medical pump of claim 1 wherein the actuator assembly further comprises a rack connected to the carriage and a pinion assembly rotatably engaging the rack such that as the pinion assembly rotates about a pivot axis the carriage is moved between the open position and the closed position.

3. The medical pump of claim 2 wherein the pinion assembly has the cam follower that engages the cam surface of the cam element such that movement along the cam surface moves the carriage between the open position and the closed position.

4. The medical pump of claim 3 wherein the cam surface has a detent wherein when the cam follower moves over the detent the carriage moves from the open position to the closed position in one direction of movement and from the closed position to the open position in an opposite direction of movement.

5. The medical pump of claim 3 further comprising a spring element connected to the cam element to bias the cam element toward the carriage.

6. The medical pump of claim 2 wherein the pinion assembly has a U-shaped body that includes the cam follower and rotates about the pivot axis.

7. The medical pump of claim 2 further comprising a lever secured to the pinion assembly to rotate the pinion assembly about the pivot axis.

8. The medical pump assembly of claim 1 wherein the lever bearing carriers a roller element that engages and moves along a spring element.

9. The medical pump assembly of claim 8 wherein the spring element has a first tang element that engages a stop element and a second elongated tang element that engages the roller element.

10. The medical pump assembly of claim 1 wherein the handle rotates at least three degrees before the cam follower begins to rotate.

11. A medical pump for use with a cassette, comprising:

a chassis having a fixed seat thereon;

a carriage connected to the chassis and having an opening therein adapted to receive a cassette, the opening forming a footing which restricts movement of the cassette within the carriage, the carriage being movable inwardly with respect to the chassis from an open position wherein the carriage is spaced from the fixed seat to a closed position to engage the cassette to the fixed seat; and an actuator assembly comprising a rack engaged by a pinion assembly having a cam follower such that as the pinion assembly rotates along the rack the carriage moves between the closed position and the open position;

wherein the cam follower is rotatably connected to a handle via a lever bearing;

wherein the lever bearing has a radial opening and a spoke and the handle has an engagement member disposed through the radial opening wherein in a first position the engagement member does not contact the spoke and in a second position when the handle is rotated the engagement member engages the spoke to rotate the lever bearing and cam follower.

12. A medical pump for use with a cassette, comprising:

a chassis having a fixed seat thereon;

a carriage connected to the chassis and having an opening therein adapted to receive a cassette, the opening forming a footing which restricts movement of the cassette within the carriage, the carriage being movable inwardly with respect to the chassis from an open position wherein the carriage is spaced from the fixed seat to a closed position to engage the cassette to the fixed seat; and a bi-stable actuator assembly having a cam follower connected to the carriage that resists movement of the carriage at the open and closed positions and prevents external force initiated movement of the main carriage from being stopped at an intermediate position between the open and closed positions when external force is withdrawn;

wherein the cam follower is rotatably connected to a handle via a lever bearing;

wherein the lever bearing has a radial opening and a spoke and the handle has an engagement member disposed through the radial opening wherein in a first position the engagement member does not contact the spoke and in a second position when the handle is rotated the engagement member engages the spoke to rotate the lever bearing and cam follower.

* * * * *